US005435371A

United States Patent [19]

Cheng

[11] Patent Number: 5,435,371

[45] Date of Patent: Jul. 25, 1995

[54] IRON ROLLING DOOR

[76] Inventor: Sui K. Cheng, No. 24-36, Yun Kee, Si Ho Ts'un, Chih Tung Hsiang, Yunlin Hsien, Taiwan

[21] Appl. No.: 204,519

[22] Filed: Mar. 2, 1994

[51] Int. Cl.[6] ..... E06B 9/08

[52] U.S. Cl. ..... 160/133; 160/174

[58] Field of Search ..... 160/133, 269, 41, 172 R, 160/174 R, 176.1 R, 34, 35, 36

[56] References Cited

U.S. PATENT DOCUMENTS

| | | | |
|---|---|---|---|
| 1,756,496 | 4/1930 | Warnick | 160/269 |
| 2,645,282 | 7/1953 | Grau | 160/133 |
| 2,812,021 | 11/1957 | Bechtler | 160/133 |
| 3,027,937 | 4/1962 | Wilson | 160/40 |
| 3,237,682 | 3/1966 | Davis | 160/133 X |
| 3,331,158 | 7/1967 | Frakes | 160/40 X |
| 4,715,421 | 12/1987 | Erber | 160/133 |
| 5,188,161 | 2/1993 | Erber | 160/133 |

*Primary Examiner*—David M. Purol
*Attorney, Agent, or Firm*—Browdy and Neimark

[57] ABSTRACT

An iron rolling door including a rolling door board structure and guide rails. The rolling door board structure is composed of multiple support rods, metal plates, connecting plates and stopper plates. Two ends of each metal plate is wound to define two circular holes through which the support rods extend. Each two adjacent metal plates are pivotally connected by the connecting plate, whereby the metal plates are able to rotate through a certain angle into an opened Or closed state. The stopper plates are fitted with the support rods for preventing the metal plates from slipping away from the support rods. Each guide rail has a guiding wall defining a guiding groove for receiving a slide plate. Two link members are disposed between the slide plate and the guiding wall and an extension spring is disposed between the link member and guiding wall. The slide plate, link member and guiding wall together form a four-link structure, whereby the rolling door board structure is slidably disposed in the guiding grooves of the guide rails to be restricted by the slide plates, and the rolling door board structure is able to rotate through a certain angle into an opened or closed state.

1 Claim, 6 Drawing Sheets

IRON ROLLING DOOR

BACKGROUND OF THE INVENTION

The present invention relates to an improved iron rolling door.

As shown in FIGS. 1 and 1A, a conventional iron rolling door is mainly composed of a rolling door board structure 9 and guide rails 90. The rolling door board structure 9 is composed of multiple support rods 91, iron plates 92 and stopper plates 93. An upper and a lower end of each iron plate 92 is wound to define two circular holes through which the support rods 91 extend. The stopper plates 93 are fitted with two sides of the support rods for preventing the iron plates 92 from slipping away from the support rods 91. Each guide rail 90 has a guiding groove 901. The rolling door board structure 9 is slidably disposed in the guiding grooves 901 of the guide rails 90 when pulled down from a storage position above the opening to be closed.

Some shortcomings exist in the above conventional iron rolling door as follows:

1. The multiple support rods extend through the iron plates and connect the same to form the rolling door board structure. According to such arrangement, almost no clearance exists between the iron plates of the assembled rolling door so that when the rolling door is closed, an indoor place can not be sufficiently lighted by the sun. This makes the indoor place dim or even dark. Moreover, the indoor place can not be properly ventilated and people indoors feel hot and uncomfortable.
2. In case of a fire, it is difficult for a fireman to for open the conventional iron rolling door for to insert water onto the fire. As a result, lives and property are seriously threatened. Furthermore, during a fire, the conventional iron rolling door prevents smoke from quickly dissipating outward. This can also cause serious injury to people.

SUMMARY OF THE INVENTION

It is a primary object of the present invention to provide an improved iron rolling door wherein the metal plates are pivotally connected with one another by multiple connecting plates. Accordingly, when the rolling door is closed, the metal plates are rotated through a certain angle into an opened state. Thus, the rolling door can be closed for for security purposes while keeping the indoor place well ventilated and lighted by the sun.

It is a further object of the present invention to provide the above rolling door, wherein the metal plates can be alternatively closely connected in a closed state so as to insure both safety and privacy.

It is still a further object of the present invention to provide the above rolling door wherein a slide plate is disposed in the guiding groove of the guide rail for adjusting the width of the guiding groove so as to respectively suit the width of the metal plate in a closed or opened state.

The present invention can be best understood through the following description and accompanying drawings, wherein:

DETAILED DESCRIPTION OF THE PREFERRED EMBODIMENT

Figure 1:
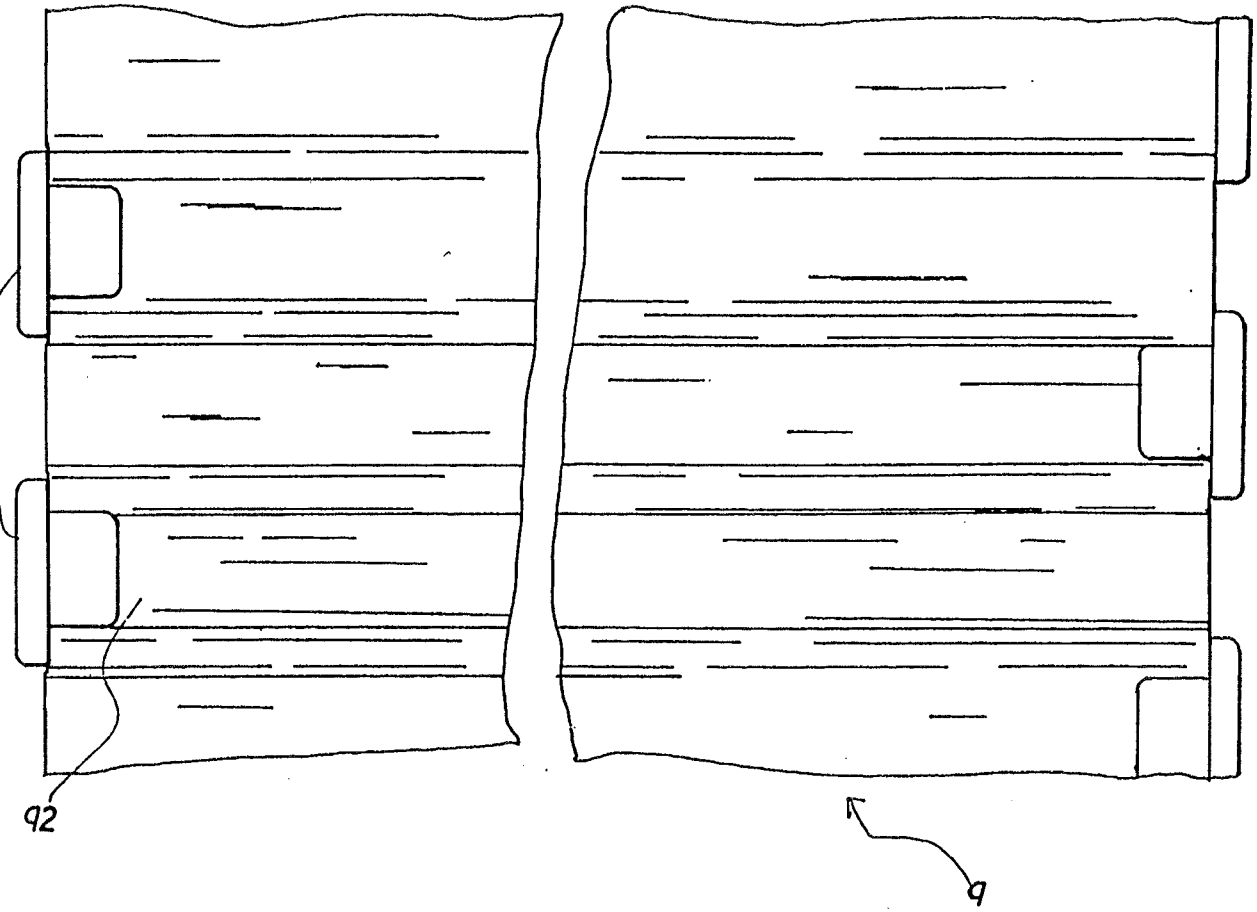
FIG. 1 PRIOR ART
FIG. 1 is an assembled view of a conventional iron rolling door board structure.
Figure 1A:
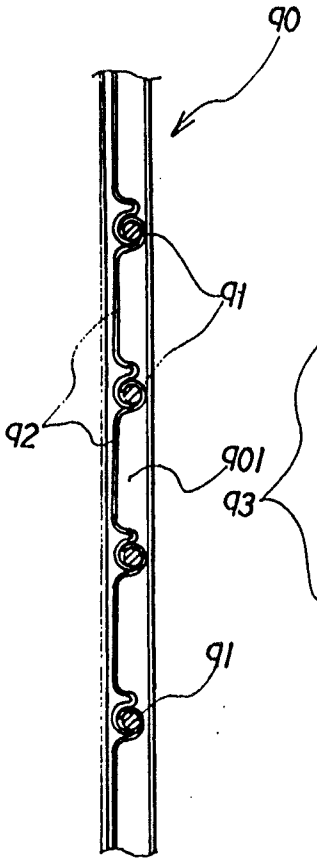
FIG. 1A PRIOR ART
FIG. 1A is a sectional view according to FIG. 1.
Figure 2:
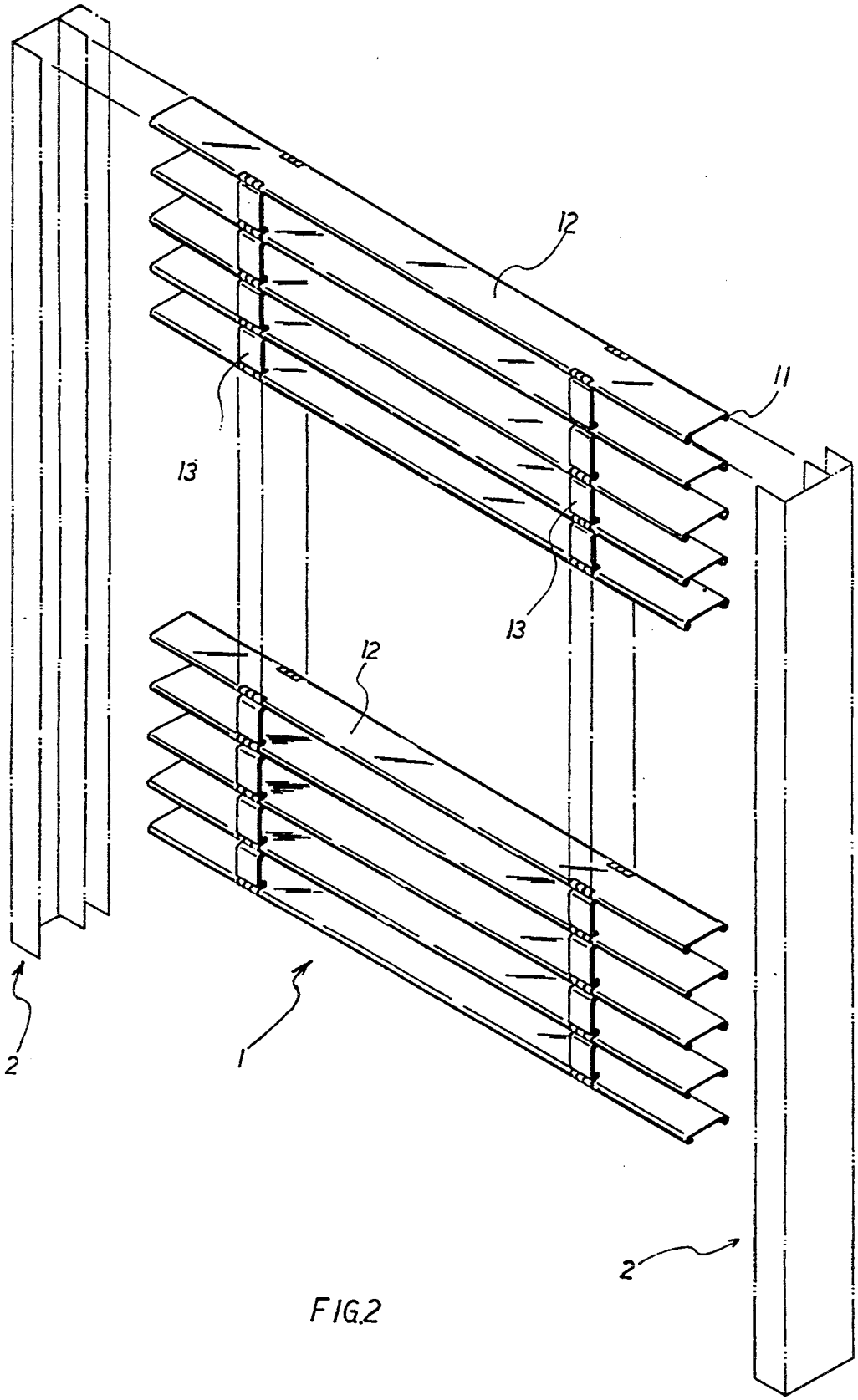
FIG. 2 is a perspective view of the present invention.
Figure 3:
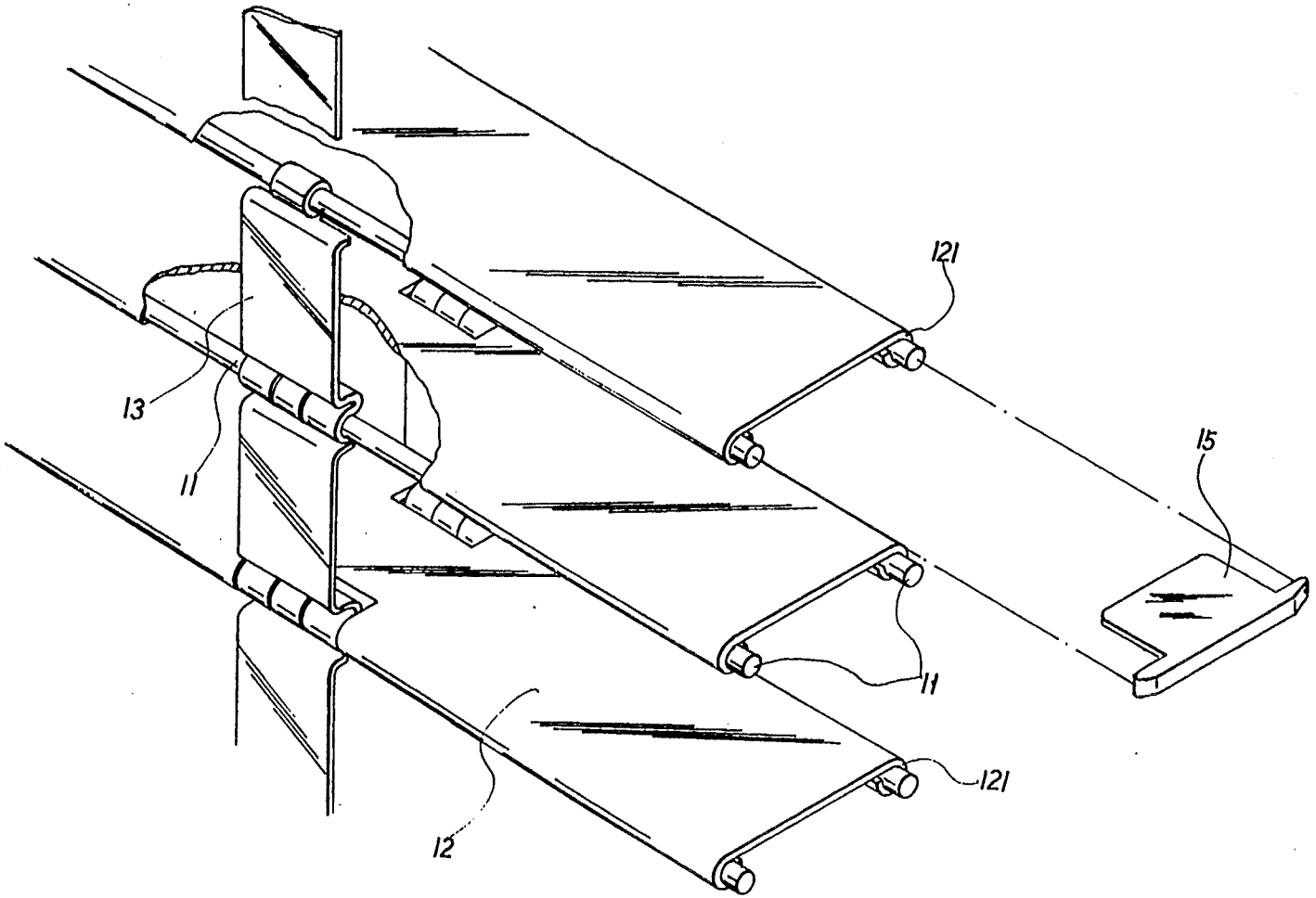
FIG. 3 is an enlarged perspective view, showing that the metal plates are pivotally connected with one another by means of the support rods and connecting plates of the present invention.

As shown in FIGS. 2–6, the iron rolling door of the present invention mainly includes a rolling door board structure 1 and guide rails 2. The rolling door board structure 1 is composed of multiple support rods 11, metal plates 12, connecting plates 13 and stopper plates 15. Two ends of each metal plate 12 are wound to define two circular holes 121 through which the support rods 11 extend. Both inner and outer sides of each two adjacent metal plates 12 are pivotally connected by the connecting plate 13. The stopper plates 15 are fitted with the support rods 11 for preventing the metal plates 12 from slipping away from the support rods 11. According to the above arrangements, the metal plates 12 are able to rotate through a certain angle into an open or close state after being pulled down from a storage position into the opening to be secured.

Each guide rail 2 is substantially U-shaped, having guiding wall 211 defining a guiding groove 21. A slide plate 22 is disposed in the guiding groove 21 and two link members 23 are disposed between the slide plate 22 and the guiding wall 211 at equal interval. An extension spring 25 is disposed between the link member 23 and the guiding wall 211, whereby the slide plate 22, link member 23 and the guiding wall 211 together form a four-link structure.

Figure 4:
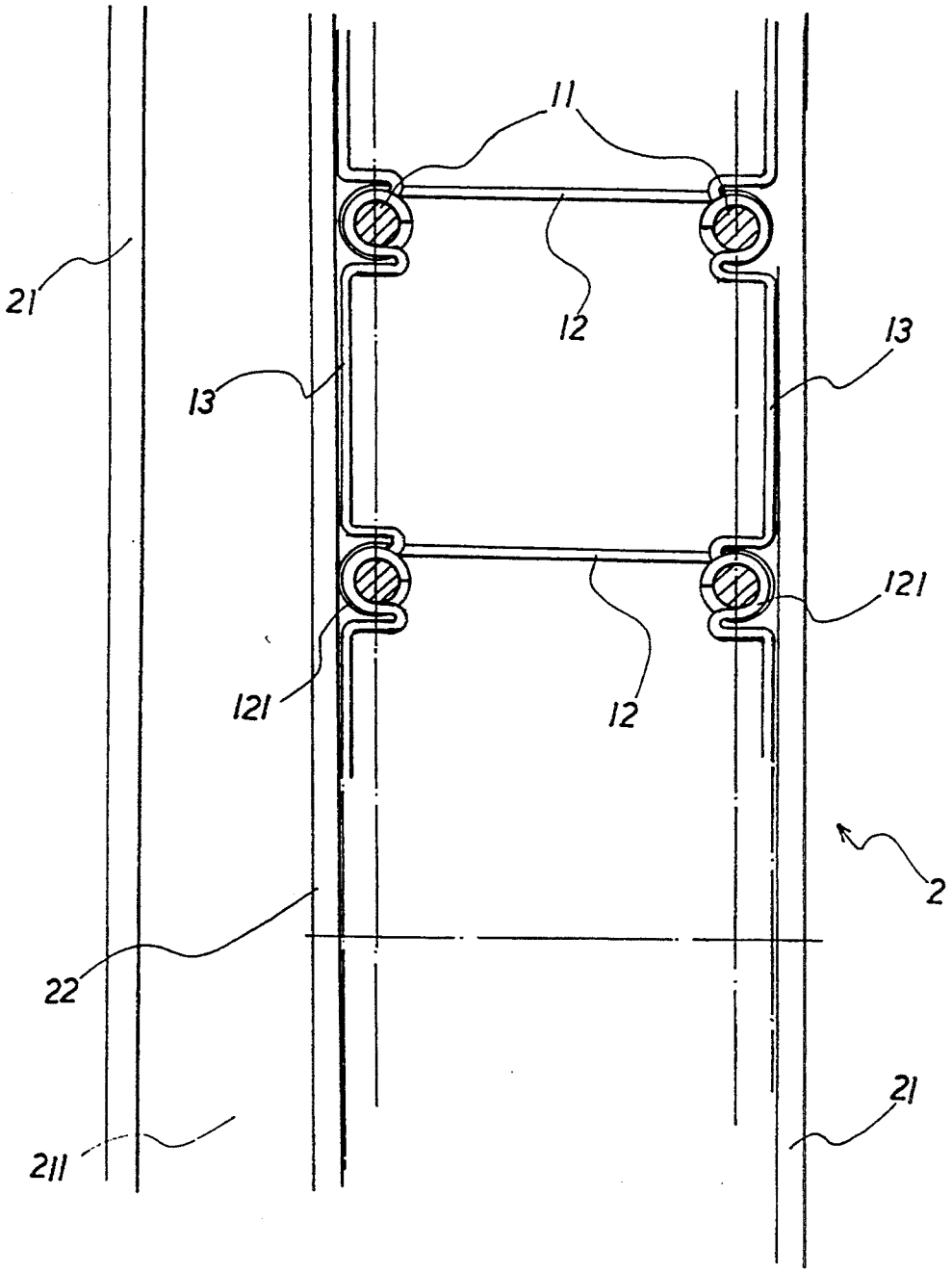
FIG. 4 is a sectional view of the assembled metal plates, support rods and connecting plates of the present invention.
Figure 5:
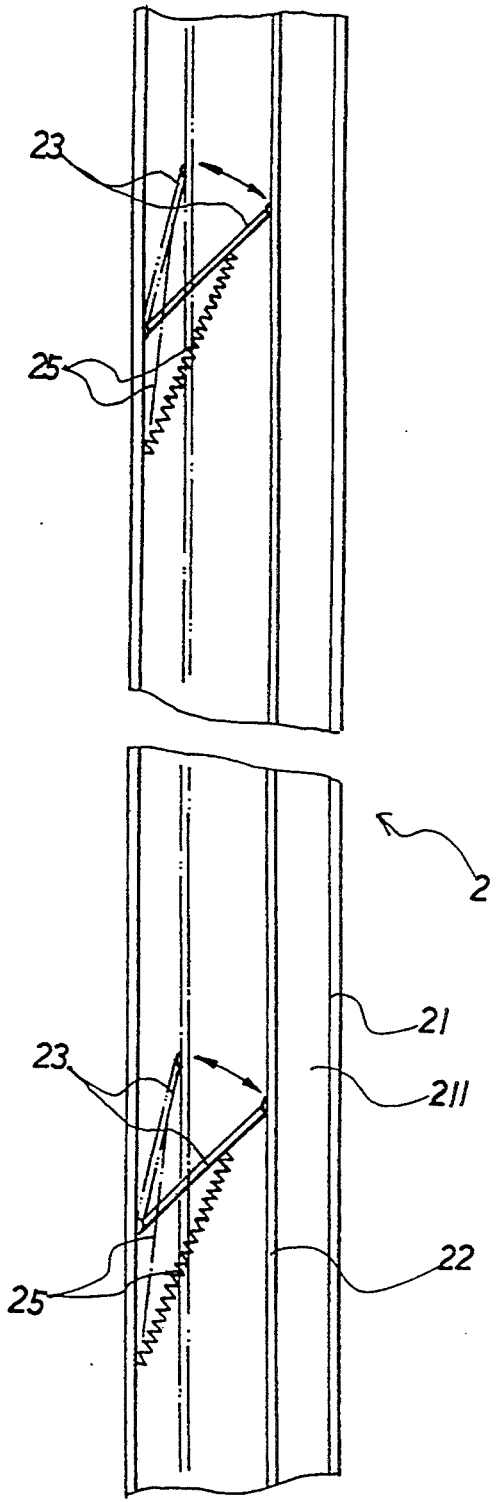
FIG. 5 shows the movement of the slide plates, link members and extension springs disposed in the guiding groove of the guide rail.
Figure 6:
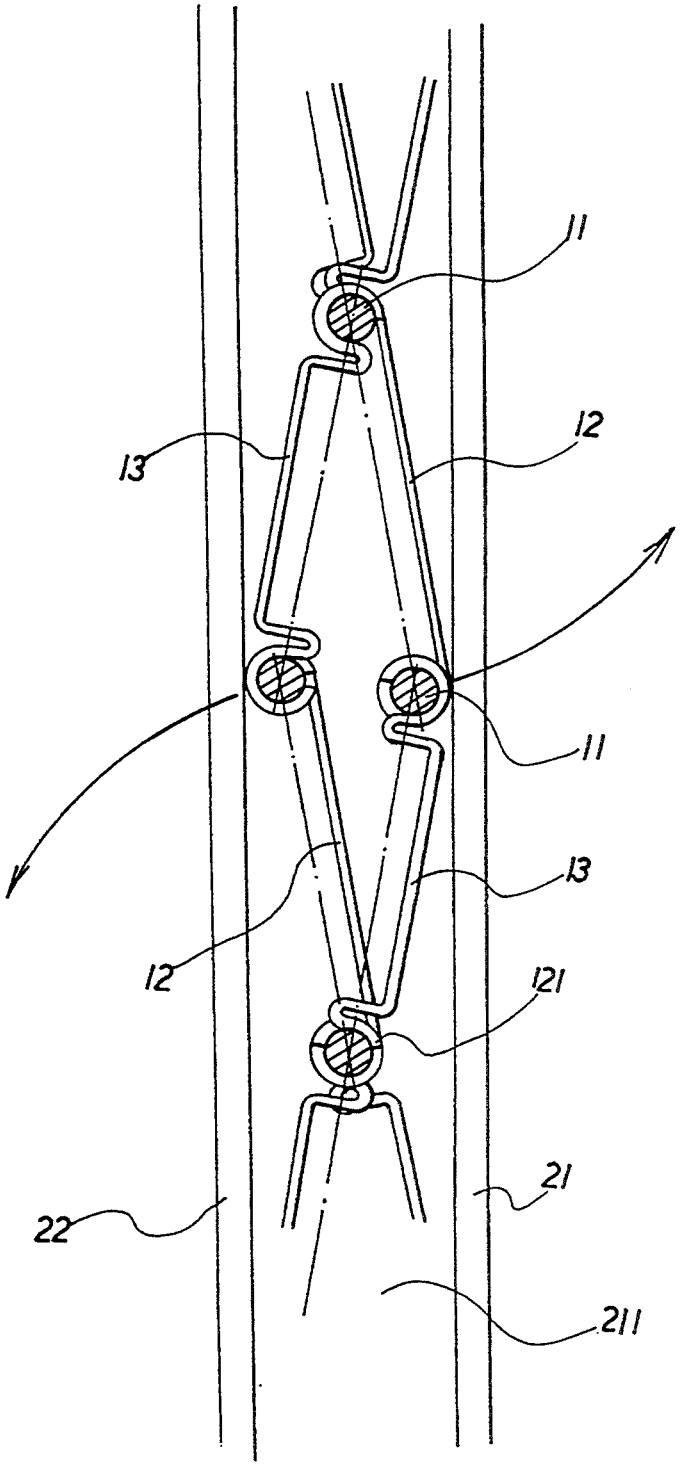
FIG. 6 shows the movement of the rolling door board structure of the present invention.

According to the above arrangements, when the rolling door board structure 1 is disposed in the guiding grooves 21 of the guide rails 2 by pulling the board structure 1 down from its storage position, the extension springs 25 are compressed to push the slide plates 22 outward. As a result, the rolling door board structure 1 is restricted by the slide plates 22 and the metal plates 12 are in a closed state. However, as shown in FIG. 4, when a bottom end of the rolling door board structure 1 contacts with the ground from its storage position and exerts a downward force thereonto, the metal plates 12 are rotated through a certain angle into an opened state. Simultaneously, the metal plates 12 push the slide plates 22 toward the guiding wall 211 to define a width of the guiding groove 21, which width allows the guiding groove 21 to receive the opened metal plates 12 with a relatively large width. When rolling the rolling door board structure 1, as shown in FIG. 6, the same is pulled upward and the metal plates 12 are forced into a close state. Simultaneously, the slide plates 22 in the guiding grooves 21 push the slide plates 22 outward due to contraction of the springs 25. At this time, the width of the guiding groove 21 is reduced to suit a relatively small width of the closed metal plates 12.

The above embodiment is only an example of the present invention and the scope of the present invention should not be limited to the example. Any modification or variation derived from the example should fall within the scope of the present invention.

What is claimed is:

1. An iron rolling door for closing an opening when pulled down from an overhead storage position comprising a rolling door board structure and guide rails, wherein said rolling door board structure is composed of multiple support rods, metal plates, connecting plates and stopper plates, two ends of each said metal plate being wound to define two circular holes through which said support rods extend, both an inner and an outer edge of each two adjacent metal plates being pivotally connected by said connecting plate, said stopper plates being fitted with said support rods for preventing said metal plates from slipping away from said support rods, wherein said metal plates are able to rotate through a certain angle into an open or close state, each guide rail of said guide rails being substantially U-shaped, having guiding walls defining a guiding groove, a slide plate being disposed in said guiding groove, two link members being disposed between said slide plate and a guiding wall of said guiding walls at an equal interval, an extension spring being disposed between said link member and said guiding wall, whereby said slide plate, link member and said guiding wall together form a four-link structure, wherein when said rolling door board structure is slidably disposed from the storage position in each said guiding groove of said guide rails and restricted by said slide plates, said rolling door board structure can be rotated through a certain angle into an opened or closed state.

* * * * *